US005934823A

United States Patent [19]

Allen

[11] Patent Number: 5,934,823

[45] Date of Patent: Aug. 10, 1999

[54] QUICK ACCESS SHROUD SYSTEM FOR RIDING TROWELS

[75] Inventor: J. Dewayne Allen, Paragould, Ark.

[73] Assignee: Allen Engineering Corporation, Paragould, Ak.

[21] Appl. No.: 08/990,798

[22] Filed: Dec. 15, 1997

[51] Int. Cl.[6] ..... E01C 19/22

[52] U.S. Cl. ..... 404/112

[58] Field of Search ..... 404/112, 85; D15/10

[56] References Cited

U.S. PATENT DOCUMENTS

| | | | |
|---|---|---|---|
| D. 323,510 | 1/1992 | Allen et al. | D15/10 |
| 3,936,212 | 2/1976 | Holtz, Sr. et al. | 404/112 |
| 4,046,484 | 9/1977 | Holz, Sr. et al. | 404/112 |
| 4,312,603 | 1/1982 | Whiteman, Jr. | 404/112 |
| 4,556,339 | 12/1985 | Morrison | 404/112 |
| 4,676,691 | 6/1987 | Morrison | 404/112 |
| 4,710,055 | 12/1987 | Masses et al. | 404/112 |
| 5,108,220 | 4/1992 | Allen et al. | 404/112 |
| 5,238,323 | 8/1993 | Allen et al. | 404/85 |
| 5,480,257 | 1/1996 | Allen | 404/112 |
| 5,480,258 | 1/1996 | Allen | 404/112 |
| 5,613,801 | 3/1997 | Allen | 404/112 |
| 5,685,667 | 11/1997 | Allen | 404/112 |

*Primary Examiner*—Thomas B. Will
*Assistant Examiner*—Raymond W Addie
*Attorney, Agent, or Firm*—Stephen D. Carver

[57] ABSTRACT

A powered riding trowel comprises a protective, quick access support shroud that may be unlatched to quickly expose the power means for service without structural disassembly. The trowel seat is mounted on top of the upper planar surface of the shroud. The shroud front and rear are preferably formed from rigid, supportive material having airflow pathways for cooling and ventilating the shroud interior. Opposite shroud ends integral with the top surface angularly depend outwardly and downwardly. In the best mode one shroud end is hinged to the trowel frame, and the opposite end is releasably coupled to the frame by spring biased latches. The preferred hinge structure comprises an outer hinge portion formed by a pivotal connection of the bottom of one shroud end. A cooperating inner hinge defined by at least one pair of inner braces is coupled to a pneumatic dampener that pivotally terminates within the shroud interior. Because of the twin hinge construction, shroud movement is defined by a pair of separate but similar arcs, resulting in precisely controlled shroud deflection. In an alternative mode both shroud ends are releasably coupled to the frame by spring biased latches.

7 Claims, 10 Drawing Sheets

QUICK ACCESS SHROUD SYSTEM FOR RIDING TROWELS

BACKGROUND OF THE INVENTION

I. Field of the Invention

The present invention relates generally to motorized concrete finishing trowels. More particularly, the present invention relates to motor powered riding trowels of the type classified in United States Patent Class 404, Subclass 112.

II. Description of the Prior Art

It has long been recognized by those skilled in the art that freshly placed concrete must be appropriately finished. Motorized riding trowels can fine finish plastic concrete on very large floor jobs soon after pouring. Motorized riding trowels have proven themselves in the industry. Their effectiveness for quickly and efficiently finishing large surfaces of wet concrete with either revolving blades or pans is undeniable, and such trowels are rapidly becoming the industry standard.

A typical power riding trowel comprises two or more bladed rotors that project downwardly and frictionally contact the concrete surface for finishing. These rotors are driven by one or more self contained motors mounted on the frame. The motors are linked to rotor gearboxes to revolve the rotors. The riding trowel operator sits on top of the frame and controls trowel movement with a steering system that tilts the axis of rotation of the rotors. The weight of the trowel and the operator is transmitted frictionally to the concrete by the revolving blades. The unbalanced frictional forces caused by rotor tilting enable the trowel to be steered.

As the freshly poured concrete "sets", it soon becomes hard enough to support the weight of the specialized finishing trowel. While concrete is still "green" (i.e., within one to several hours after pouring depending upon the concrete mixture involved), power trowel pan finishing is required. Soon after panning, trowelling with power blades may begin as the slab adequately hardens. Numerous concrete finishing machines are known in the art for these purposes. Proper and timely finishing insures that desired surface characteristics including smoothness and flatness are achieved.

Power riding trowels should be passed over the surface being treated several times as the concrete sets. It is recommended that finishing pans be used first, when the concrete is relatively green, to achieve "super-flat" and "super-smooth" floors. The advent of more stringent concrete surface finish specifications using "F" numbers to specify flatness (ff) and levelness (fl), dictates the use of pans on a widespread basis. Pan finishing is normally followed by high speed blade finishing, after the pans are removed from the rotor blades. The trowel blades are adjusted to a relatively high pitch angle, and they directly frictionally contact the concrete surface. Rotors operate at high speed, in excess of one hundred-fifty RPM or more, resulting in a smooth, slick surface. High power riding trowels that quickly and efficiently finish large surfaces of wet concrete with either revolving blades or pans are rapidly becoming the industry standard.

Holz, in U.S. Pat. No. 4,046,484 shows a twin rotor riding trowel. U.S. Pat. No. 3,936,212, also issued to Holz, shows a three rotor riding trowel powered by a single motor. Although the designs depicted in the latter two Holz patents were pioneers in the riding trowel arts, the devices were difficult to steer and control.

Prior U.S. Pat. No. 5,108,220 owned by Allen Engineering Corporation, the same assignee as in this case, relates to an improved, fast steering system for riding trowels. Its steering system enhances riding trowel maneuverability and control. The latter fast steering riding trowel is also the subject of U.S. Des. Pat. No. 323,510 owned by Allen Engineering Corporation.

Allen Engineering Corporation U.S. Pat. No. 5,613,801 issued Mar. 25, 1997 discloses a power riding trowel equipped with twin motors. The latter design employs a separate motor to power each rotor. Steering is accomplished with structure similar to that depicted in U.S. Pat. No. 5,108,220 previously discussed.

Allen U.S. Pat. No. 5,480,257 depicts a twin engine powered riding trowel whose guard structure is equipped with an obstruction clearance system. When troweling areas characterized by projecting hazards such as pipes or ducts, or when it is necessary to trowel hard-to-reach areas adjacent walls or the like, the guard clearance structure may be retracted to apply the blades closer to the target region.

Allen U.S. Pat. No. 5,685,667 depicts a twin engine riding trowel using "contra rotation." For enhanced stability and steering, the rotors rotate in a direction opposite from that normally expected in the art.

Although large, high power trowels are respected for their speed, horsepower, and efficiency, there are other considerations that deserve attention. For example, modern high power trowels require periodic maintenance and inspection. Easy access to critical parts is desirable. Downtime can be minimized by proper design that eases mechanical service requirements. Those parts that are most likely to require service from time to time should be easily accessed. At the same time, ease of access should not denigrate safety consideration. Very hot parts, for example, should be shrouded properly to prevent burns. (And adequate airflow must be established for proper cooling.) Besides service efficiency, operator comfort must be a paramount design goal.

With extremely large pours, troweling (i.e., panning) may begin soon after placement, continuing to late in the evening. Very large jobs may require two or more riding trowels, as critical finishing should ideally be completed before the concrete reaches a predetermined hardness. Thus the work hours may be long, and operator comfort must be insured. While operating a typical riding trowel the operator is obviously exposed to vibration, noises, and heat. The operator needs a comfortable, adjustable seat. Ideally, the seat is readily accessible to the controls. Further, the seat, and the platform mounting the seat, should be designed to dissipate the considerable heat generated by the high power trowel engines. In multiple engine designs airflow and cooling considerations are even more important. An ideal arrangement is obtained by combining the operator seat supporting structure with a ventilation pathway capable of readily dissipating engine exhaust heat. While the support structure preserves operator comfort and promotes safety, it may be relatively quickly released and deflected out-of-the way to expose critical trowel parts for service.

SUMMARY OF THE INVENTION

My new seating and shrouding system for riding trowels emphasizes operator comfort and safety while at the same time maximizing service efficiency. The powered riding trowel of the present invention comprises one or more engines with conventional bladed rotors. A protective shroud is pivotally mounted to the frame to shroud or guard the motor. When desired, the shroud is simply unlatched and quickly displaced to expose the motor and other parts without machine disassembly. In the best mode of the invention known to me at this time, one shroud end is hinged to the frame and the opposite end is selectively latched. In an alternative embodiment both shroud ends are releasably latched to the frame.

Preferably an operator's seat is adjustably mounted on top of the shroud. A control panel is accessible from the seat. The steering system and other details of this invention are set forth in prior U.S. Pat. Nos. 5,108,220, 5,613,801, 5,480,257, and 5,685,667 are hereby incorporated by reference herein.

The protective shroud encloses the engine compartment. The shroud has an upper flat surface on top that supports the adjustable seat. The shroud front and rear are preferably formed from rigid, supportive sheet-like material. In the best mode perforated steel mesh forms the front and rear. This construction establishes a positive airflow through the shroud interior. The opposite shroud ends are integral with the top surface and angularly depend outwardly and downwardly. Each end comprises numerous spaced apart ventilation louvers for enhanced air flow and cooling.

The preferred hinge structure comprises inner and outer hinge portions. An outermost hinge is formed by a pivotal connection of the bottom of one shroud end to the frame. A cooperating inner hinge is formed from at least one inner brace coupled to a preferably pneumatic dampener. The dampener (i.e., preferably an air cylinder) pivotally terminates within the shroud interior. The twin hinge construction defines a pair of separate but similar arcs of movement that establish controlled shroud deflection. In the alternative embodiment manually operated spring biased latches mount both ends of the shroud.

Therefore, a basic object is to provide a comfortable, ergonomic riding trowel.

Another basic object is to provide a comfortable, ergonomic seating and shroud system for use with a variety of power riding trowels.

A further object is to maximize operator comfort in a power riding trowel.

It is a fundamental object to keep the operator's hands away from critical moving parts.

A related object is to normally block operator access to any hot parts that may produce burns.

Another object is to provide an ergonomically optimized seating support in a power riding trowel.

Another object is to provide a quick access hood or shroud system for power riding trowels that may be easily displaced to an out-of-the way position for trowel service.

Another basic object is to maximize ease of service.

A further object is to combine a seating support of the character described with a properly ventilated shroud so that the considerable heat developed during power troweling can be dissipated properly.

A related object is to develop an air path that efficiently directs exhaust heat away from the operator seat.

Another object is to provide a seating and ventilation system of the character described that is suitable for use with single engine or multiple engine machines.

An object of the present invention is to provide a serviceable riding trowel that is capable of quick adjustment.

A related object is to provide a comfortable trowel for panning or blading operations.

An object of the present invention is to provide a riding trowel that increases production and operator efficiency.

A related object is to provide a ventilation system that is particularly well suited for very large, quick curing concrete jobs.

Another basic object is to provide a high speed, multiple rotor trowel that efficiently dissipates heat with maximum operator comfort.

It is also an object to provide a high power riding trowel that comfortably finishes concrete for long hours.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

The preferred powered riding trowel is seen in FIGS. 1–7, and an alternative trowel is depicted in FIGS. 8–12.

I. Best Mode

Figure 1:
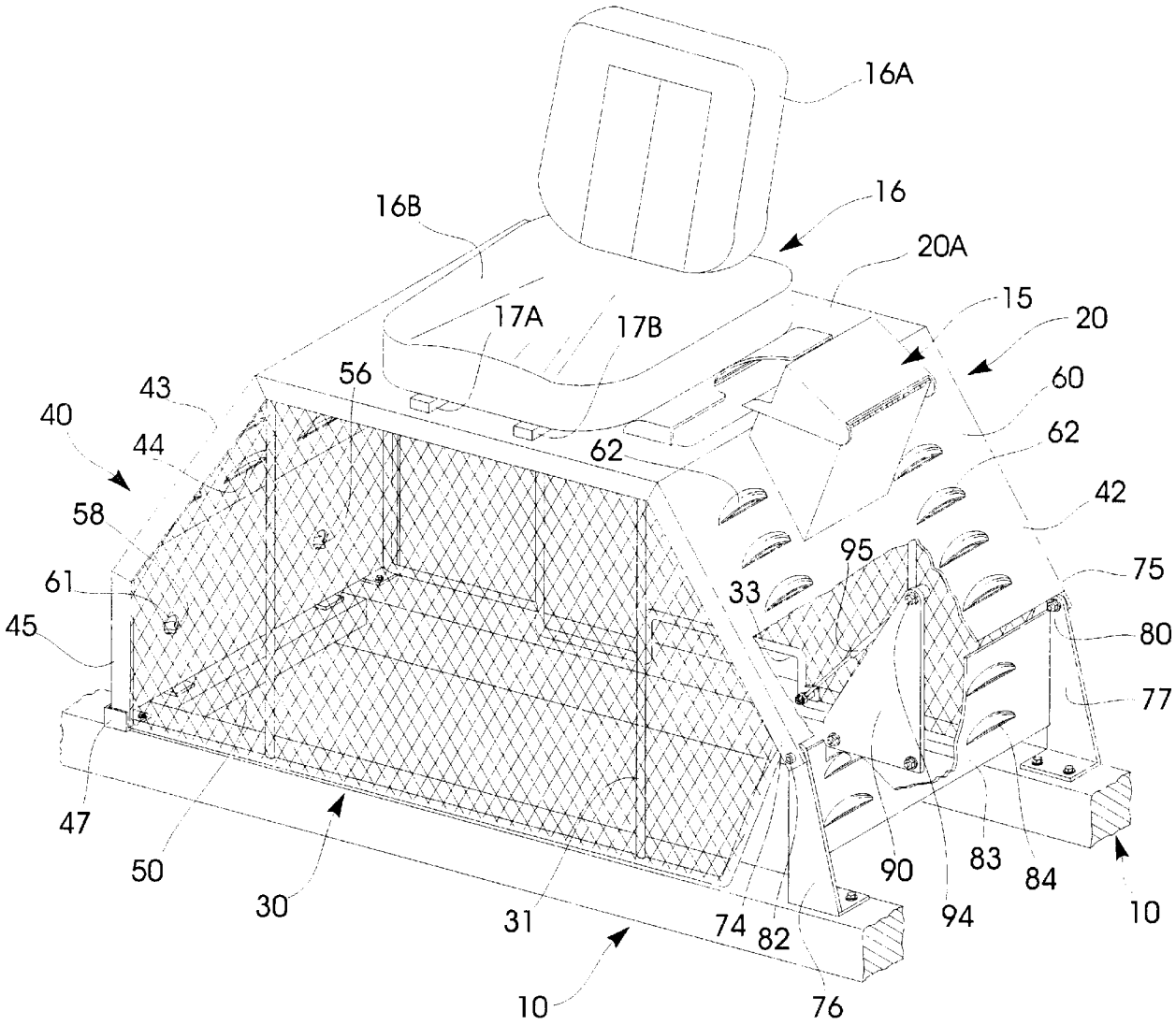
FIG. 1 is a fragmentary, front isometric view of the best mode of a riding trowel equipped with my ventilated quick access shroud seating system, with portions omitted for clarity.
Figure 2:
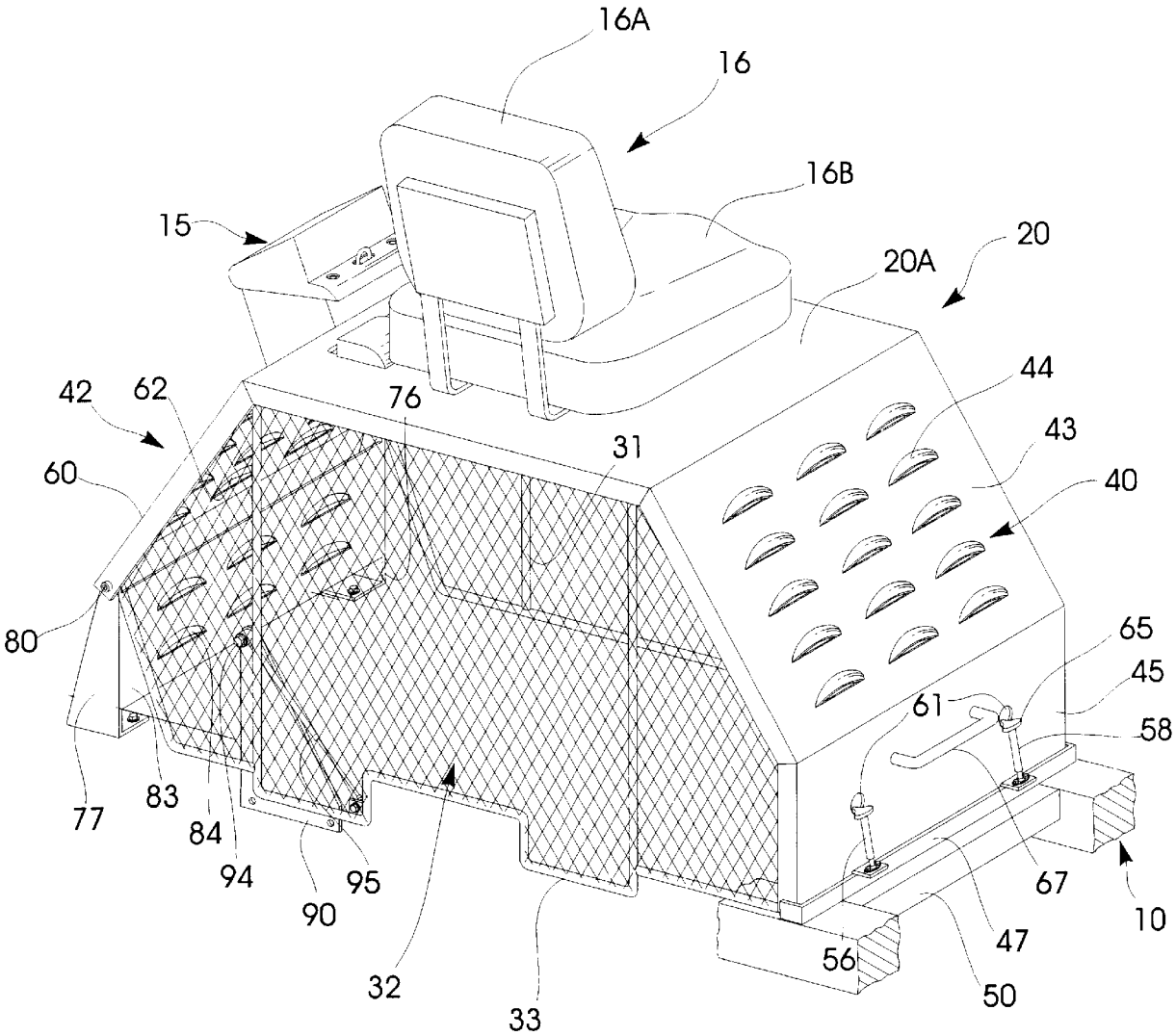
FIG. 2 is a fragmentary rear, isometric view with portions omitted for clarity.
Figure 3:
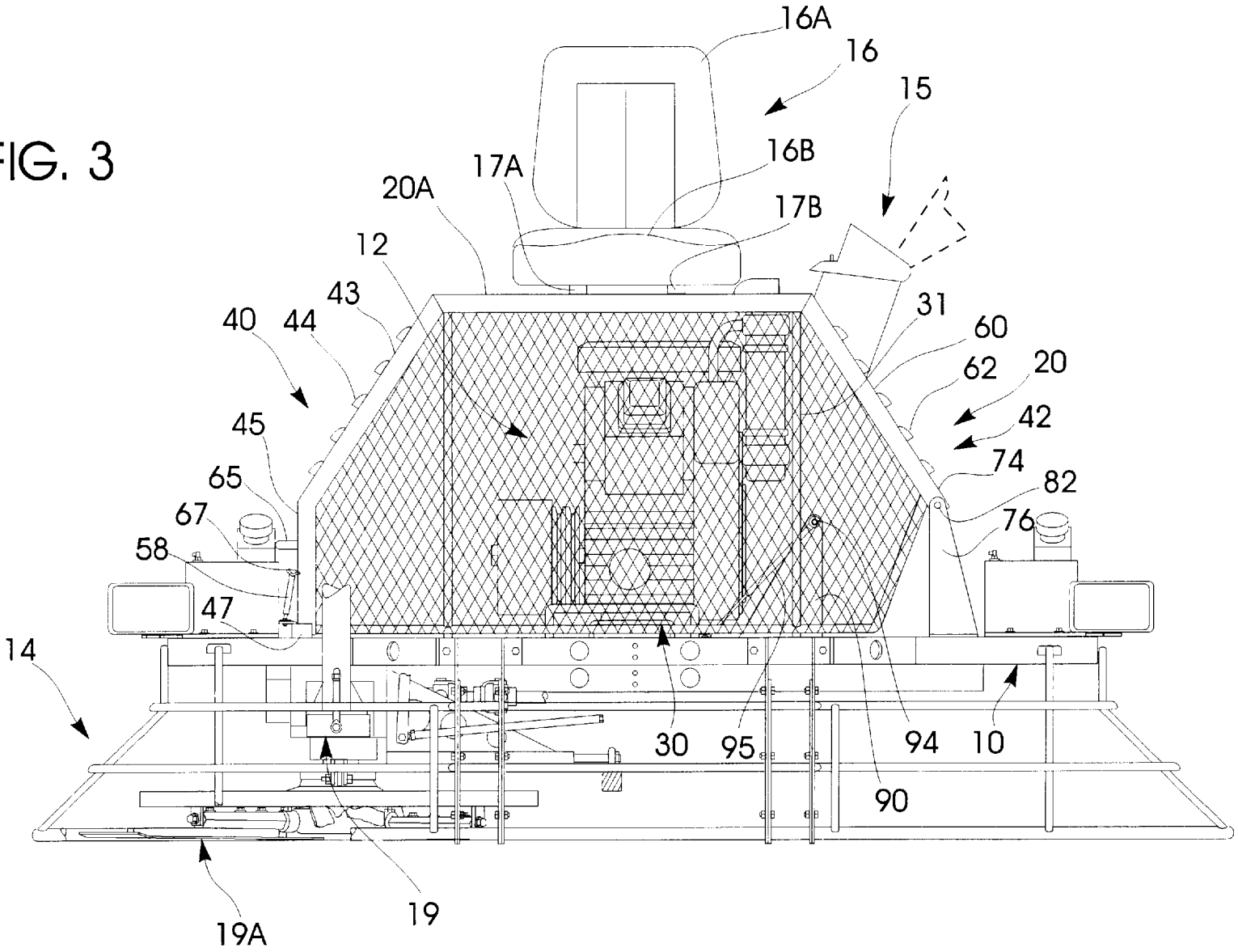
FIG. 3 is a fragmentary, front elevational view of a trowel with my new system illustrating the cage, and with portions omitted for clarity.
Figure 4:
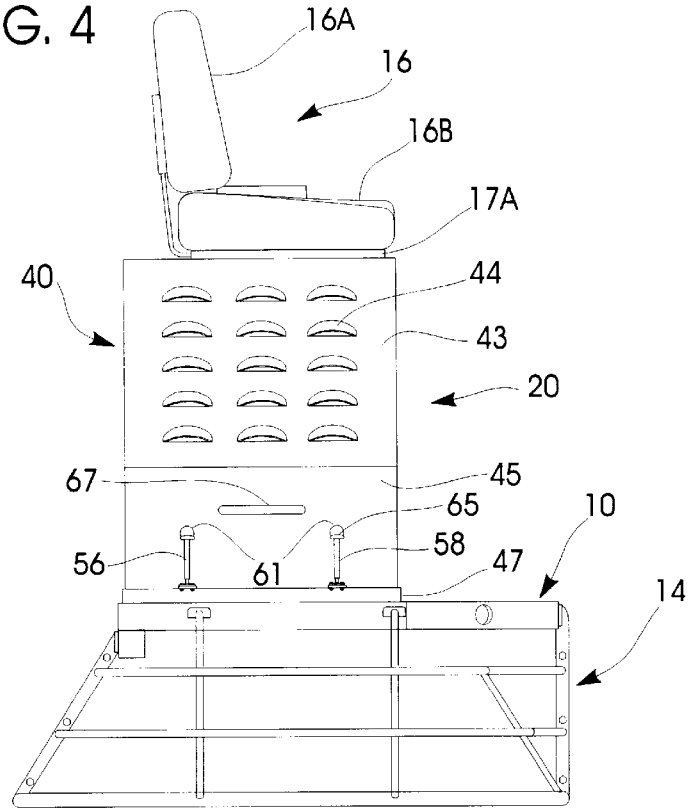
FIG. 4 is a night side elevational view.
Figure 5:
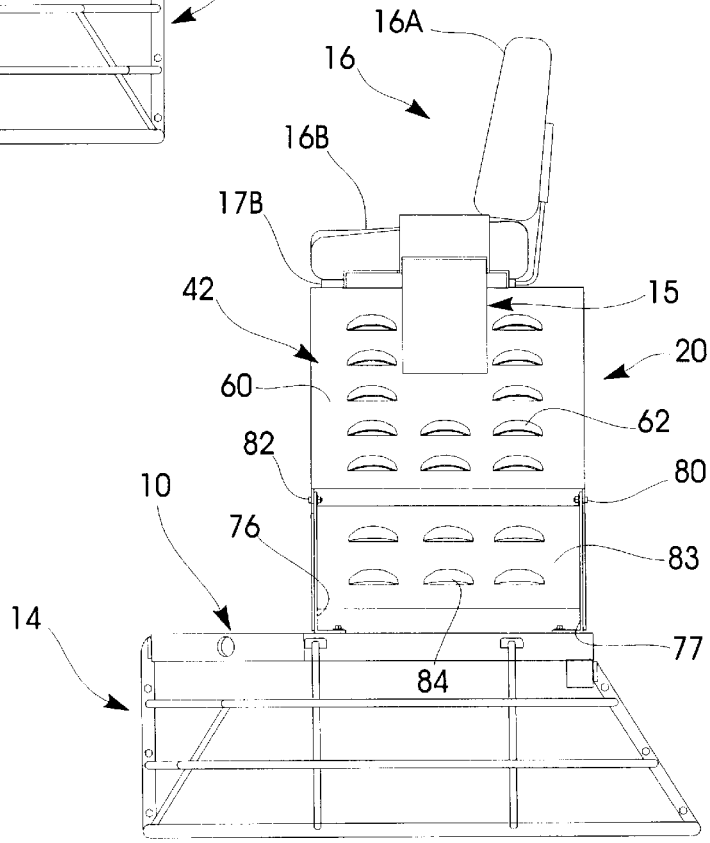
FIG. 5 is a left side elevational view.
Figure 6:
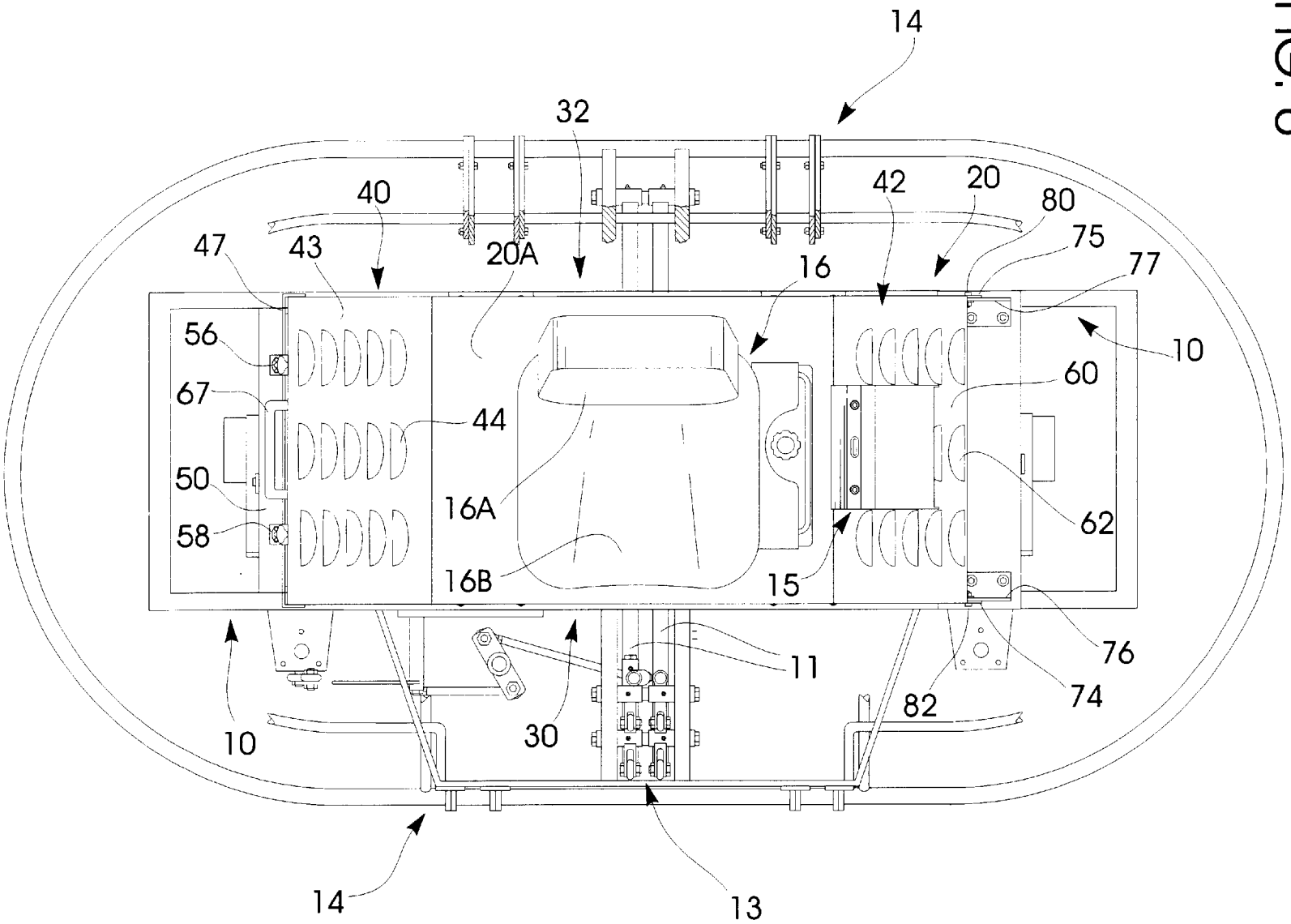
FIG. 6 is a fragmentary top plan view with portions omitted for clarity.
Figure 7:
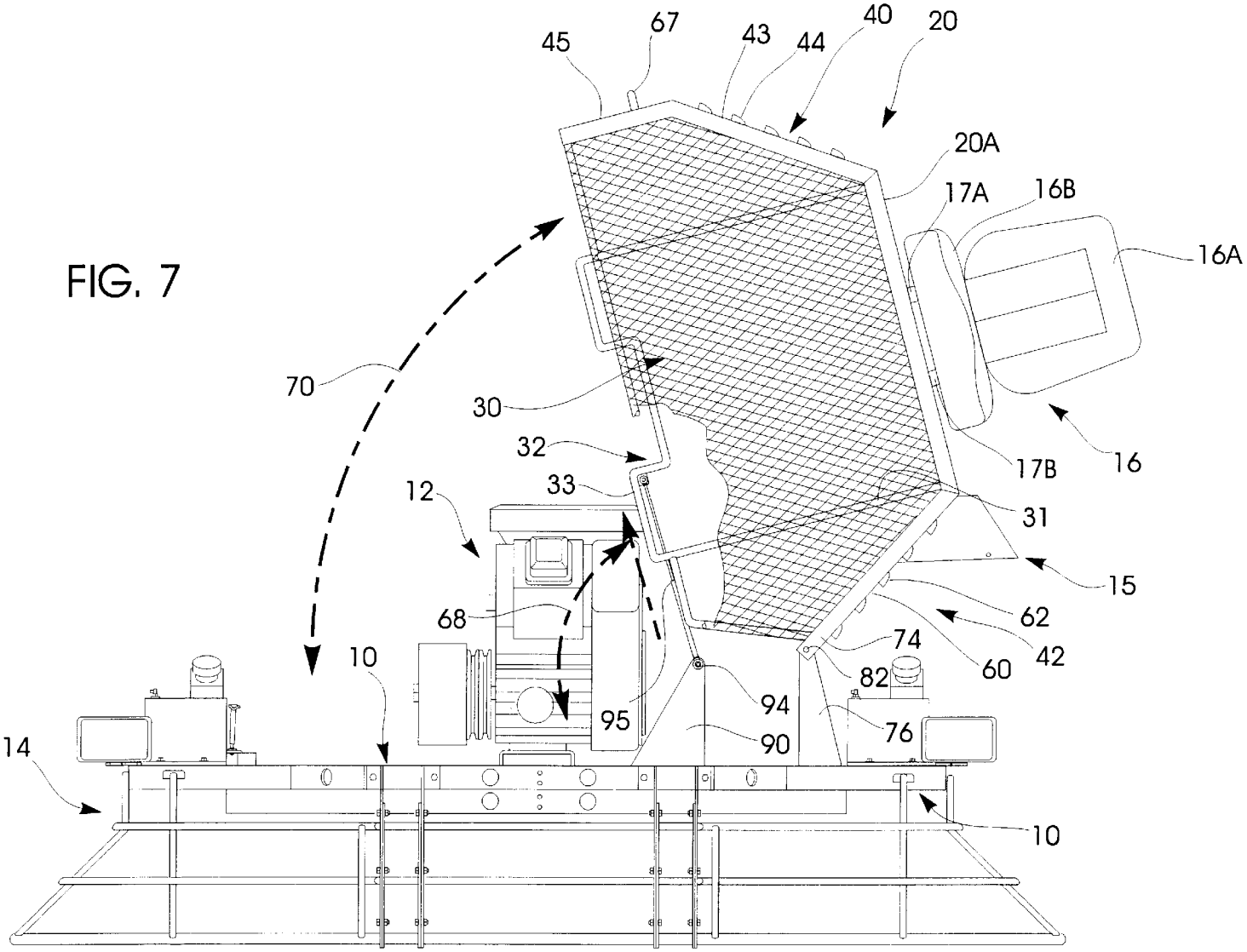
FIG. 7 is a fragmentary, front elevational view showing the preferred shroud deflected to a service position, with portions omitted and broken away for clarity.
Figure 8:
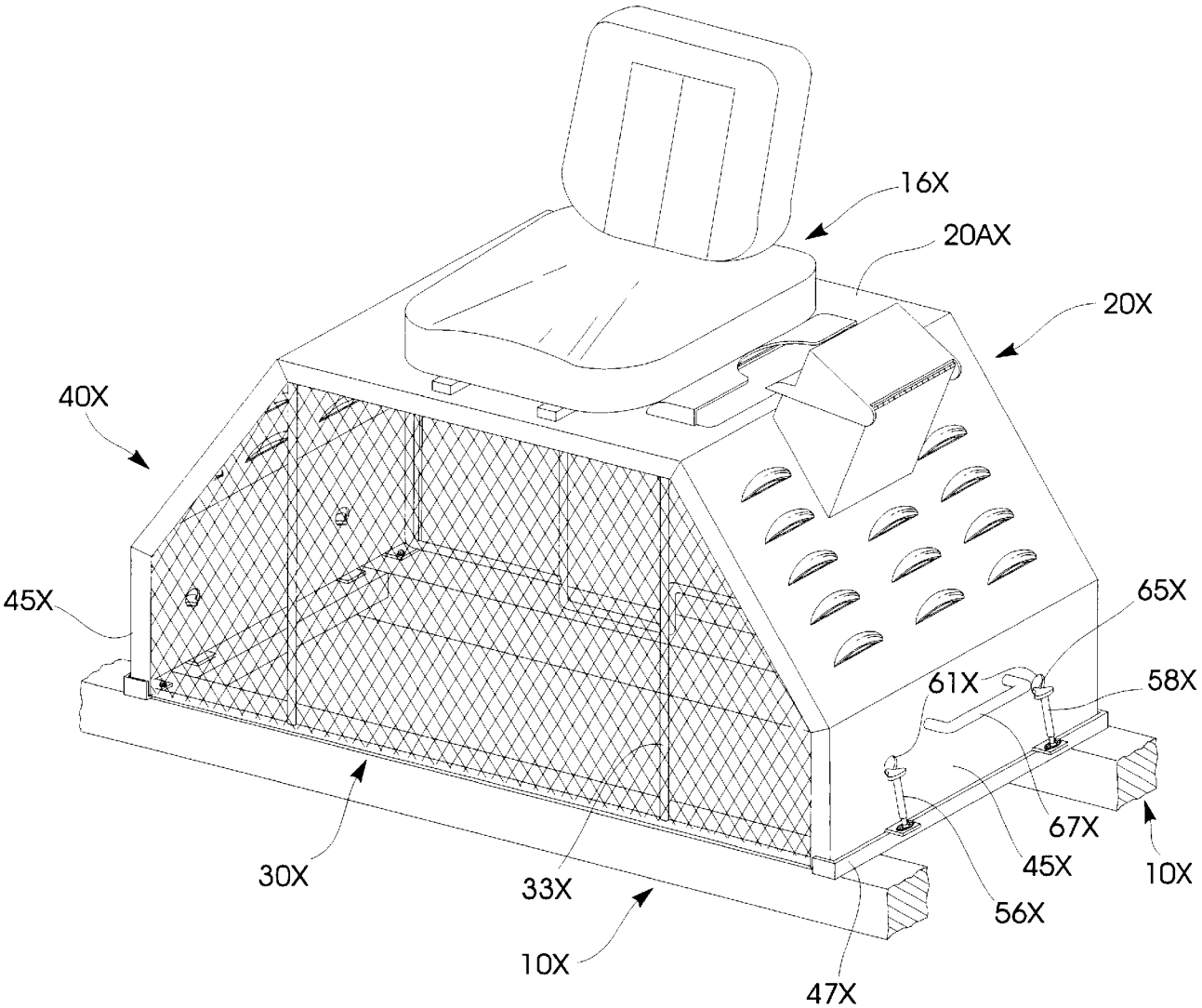
FIG. 8 is a fragmentary, front isometric view of an alternative riding trowel wherein the shroud is equipped with latches at both ends.

Each trowel may comprise one or more engines 12 or 12X (FIG. 7 or 12) and one or more bladed rotors 19 (FIG. 3) projecting downwardly from the frame 10. A protective cage 14 mounted to the frame guards the revolving blades 19A (FIG. 3). The operator's seat 16 is supported above the frame 10 upon a supportive shroud 20 to be described in detail hereinafter. A control panel 15 is freely accessible from the seat. The steering system preferably comprises a pair of parallel lever arms 11 (FIG. 6) extending beneath the frame that are actuated by suitable linkages 13. Details of this invention relating to motors, rotors, steering, rotor tilting, steering linkages, rotor configuration, blade construction and the like are set forth in prior U.S. Pat. Nos. 5,108,220, 5,613,801, 5,480,257 and 5,685,667, which, for disclosure purposes, are hereby incorporated by reference. The latter four patent references are all owned by Allen Engineering Corporation, With attention now directed to the accompanying drawings, protective shroud 20 supports seat 16 upon a planar platform 20A (FIG. 2) above the trowel frame 10. Seat 16 preferably comprises an adjustable backrest 16A and a seat portion 16B adjustably supported by rails 17A, 17B upon the shroud top surface 20A (FIG. 1). As best seen in FIGS. 1, 2, and 7, the shroud 20 is generally in the form of a truncated trapezoid. Its front 30 (FIG. 1) and its rear 32 (FIG. 2) are trapezoidally shaped. The front 30 and rear 32 are preferably formed from rigid material that establishes an airflow. Perforated steel plate may be used, although steel mesh material of approximately ten or twelve gauge is preferred. A generally rectangular subframe 31 (FIGS. 1, 7) reinforces front 30, and a similar subframe 33 (FIG. 2) reinforces rear 32. The preferred mesh construction establishes a positive airflow between the front 30 and rear 32 of the shroud 20 to dissipate heat. The engine 12 (FIG. 7) is protectively captivated between the shroud front and back.

Shroud 20 is preferably formed from rigid, ten gauge metal. Right end 40 (FIG. 2) and left shroud end 42 (FIG. 1) angularly depend outwardly and downwardly from integral, supportive shroud surface 20A. End 40 comprises an integral, acutely angled, planar plate 43 equipped with a plurality of spaced apart ventilation louvers 44. Plate 43 intersects an integral, downwardly depending perpendicular end portion 45. The end portion 45 is releasably coupled to the trowel frame by a pair of spaced apart, spring biased latches 56, 58 (FIG. 2). These latches extend from a latch mounting rail 47 secured to trowel framework 50. By lifting upwardly on the latches, the prong portions 65 may be withdrawn from shroud orifices 61. At this time, the shroud is free to be pivoted upwardly away from the motor by handle 67. Hinge structure, to be described later, insures travel as indicated by arrows 68, 70 (FIG. 7).

With primary attention directed now to FIGS. 1 and 7, the left end of the shroud 42 is hinged to allow movement once the latches 56, 58 (FIG. 2) are released. Shroud end 42 has an integral, angled plate portion 60 similar to plate 43 previously discussed. It includes louvers 62. The control box 15 is preferably mounted upon plate 60. The lowermost ends 74, 75 of shroud end plate 60 are pivotally coupled with fasteners 80, 82 to external supports 76, 77 (FIG. 1) mounted to the trowel frame 10. Supports 76, 77 provide an outermost hinge that cooperates with an inner hinge resulting between inner brace 90 (FIG. 7). Preferably a perpendicularly oriented, protective cover plate 83 (FIGS. 1, 5) extends between supports 76, 77. The inner and outer hinges thus defined safely enable controlled shroud deflection.

The inner hinge is formed by a appropriate pivot connection to the subframe 33 and upper portion of inner brace 90. Inner brace 90 is mounted at the bottom to the trowel frame 10. The convergent upper portion of the brace 90 forms a pivot with a fastener 94 (FIG. 7) forming a pivot with an air cylinder 95 used for dampening. The air cylinder is pivoted at one end to the brace 90 at point 94 and the opposite end to the back subframe 33 previously discussed.

When the shroud 20 is opened as in FIG. 7 to expose the motor for service, the cylinder 95 elongates. Arc 68 (FIG. 7) is defined about pivot 94. Arc 70 is defined about pivot 82. In this manner, the shroud is stably braced during movement. Maximum elongation of the cylinder 95 limits movement.

II. Alternative Embodiment

The alternative power riding trowel of FIGS. 8–12 is similar to that previously described. For ease of reading, the reference numerals used with this embodiment are the same as before for similar parts, except that the suffix "X" has been added to the previous numerals. The operator's seat 16X is supported above the frame 10X upon removable shroud 20X to be described in detail hereinafter. The rotors project downwardly into contact with the concrete, being shrouded by guard 14X. As before, shroud 20X is generally in the form of a truncated trapezoid. It is substantially shaped the same as before. A preferably mesh front 30X is spaced from a similar rear 32X (FIG. 9) that is braced by reinforcement 33X. As before, the engine 12X (FIG. 12) is completely inaccessible unless shroud 20X is removed.

Figure 9:
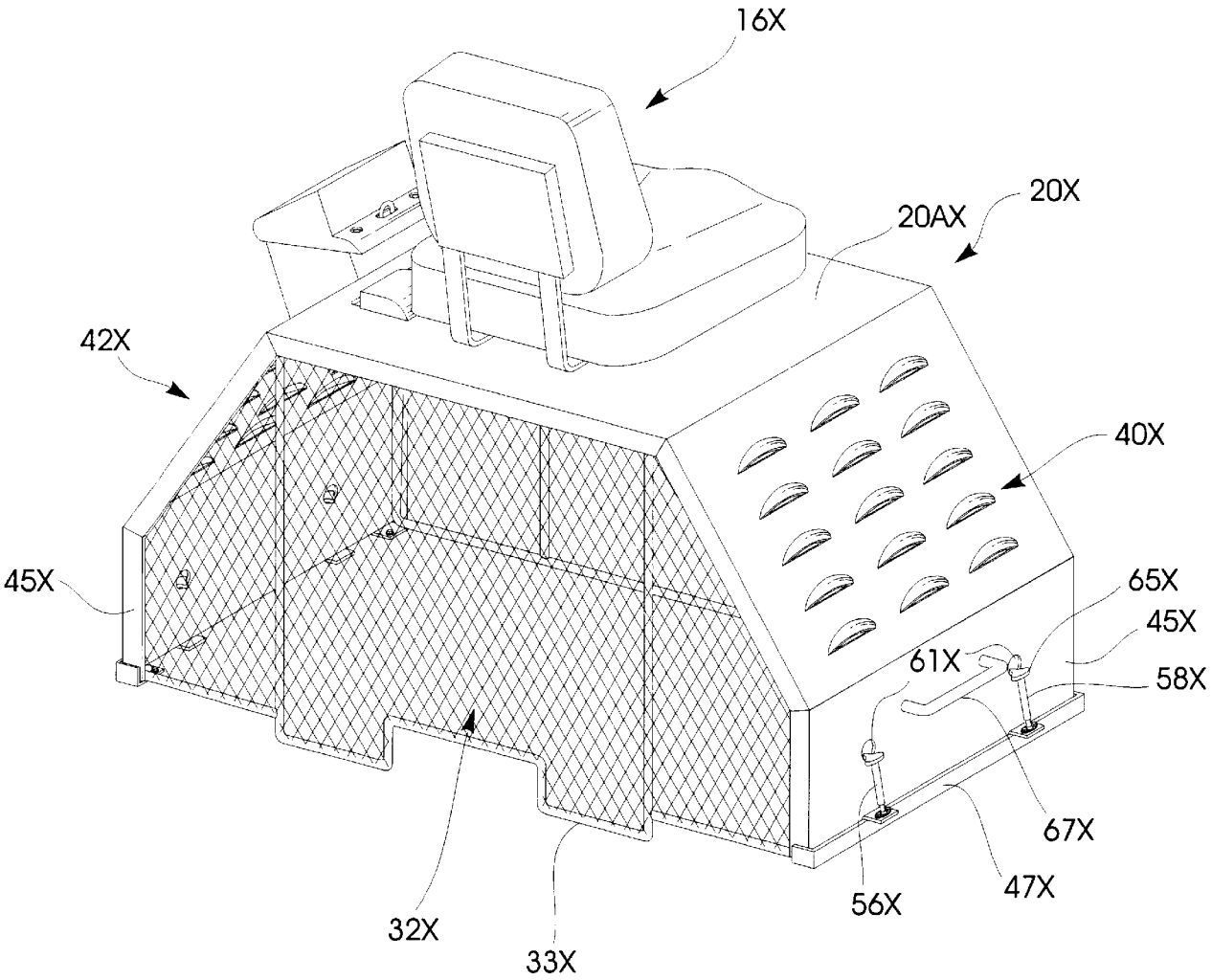
FIG. 9 is a fragmentary rear, isometric view of the alternative embodiment of FIG. 8, with portions omitted for clarity.
Figure 10:
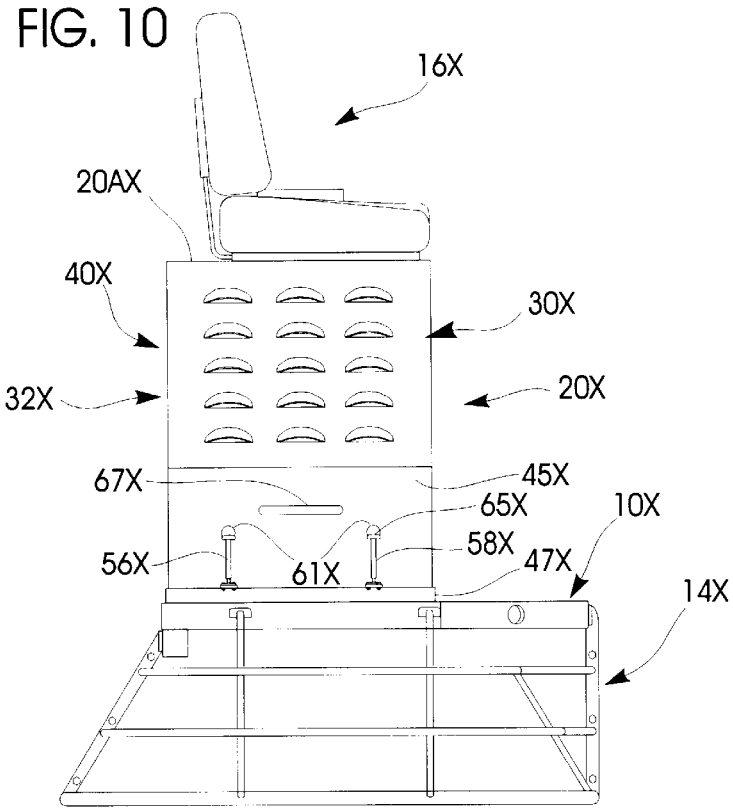
FIG. 10 is a right side elevational view of the trowel of FIGS. 8–9.
Figure 11:
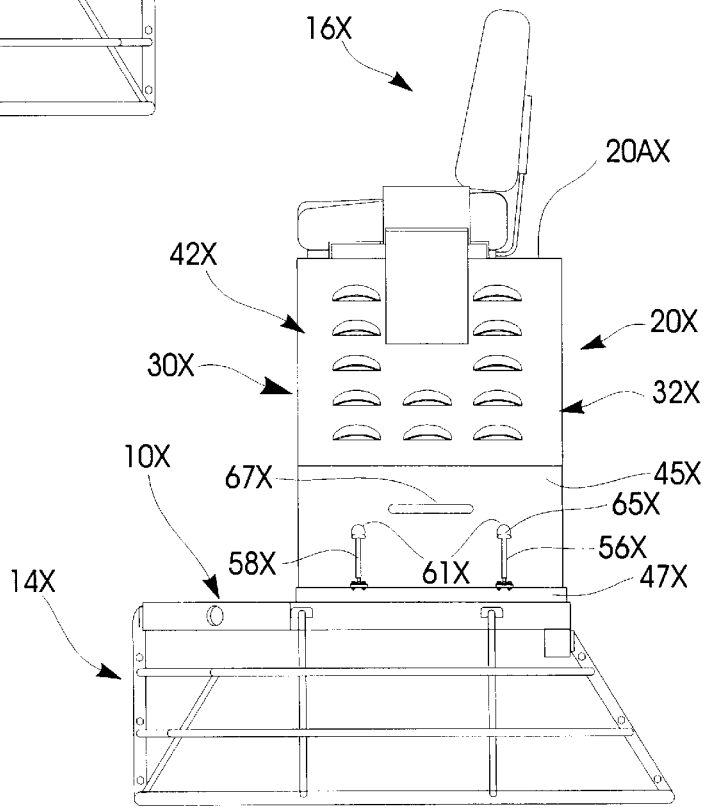
FIG. 11 is a left side elevational view of the trowel of FIGS. 8–10; and, FIG. 12 is a fragmentary, partially exploded front elevational view of the alternative trowel showing the shroud seat support moved upwardly, with portions omitted and broken away for clarity.
Figure 12:
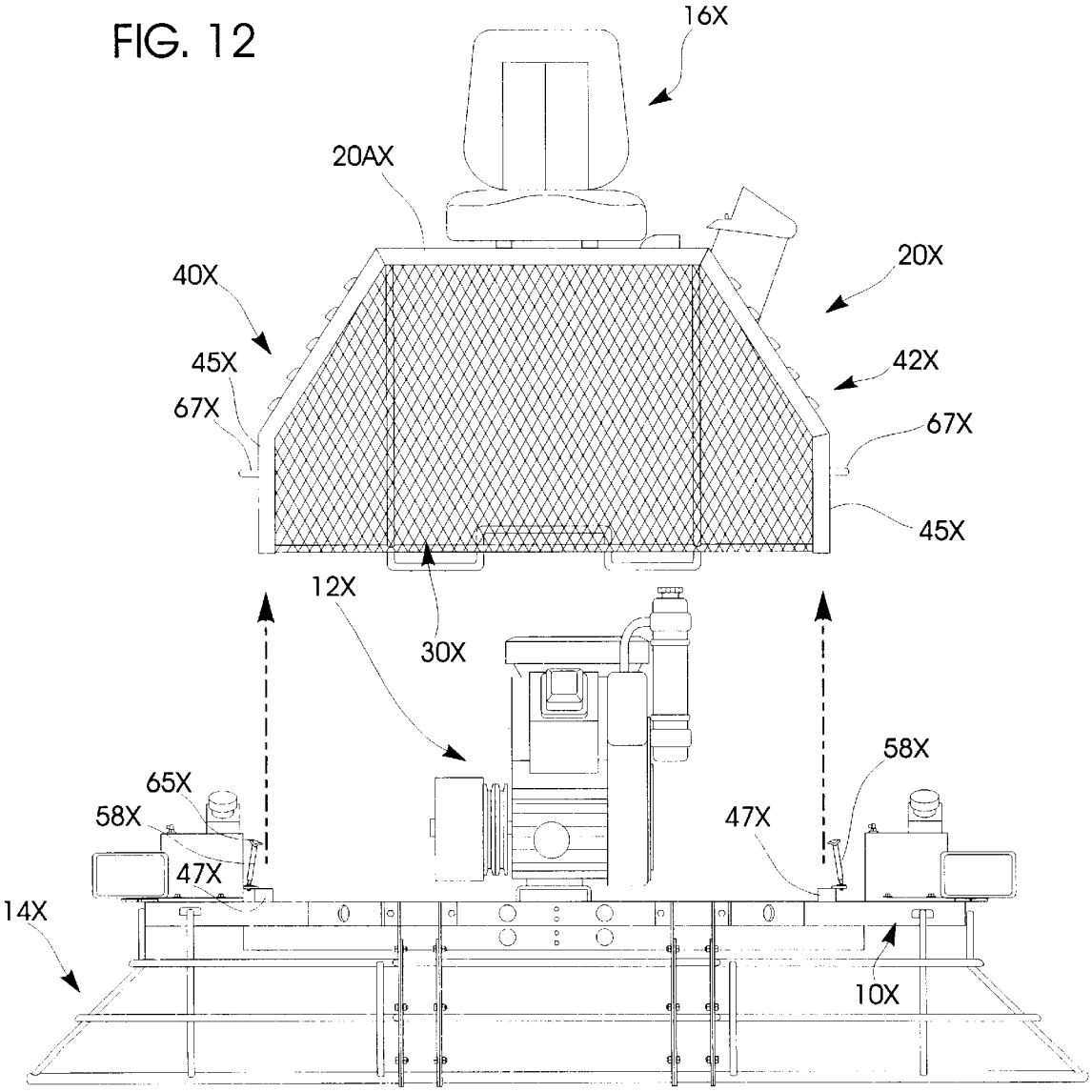

Right end 40X (FIG. 10) and left end 42X (FIG. 11) angularly depend outwardly and downwardly from integral, supportive shroud surface 20AX (FIG. 9). Each end 40X, 42X comprises an integral, acutely angled, planar plate comprising a plurality of spaced apart ventilation louvers. The integral, vertical end portions 45X (FIGS. 9, 10) are releasably coupled to the trowel frame by pairs of spaced apart, spring biased latches 56X, 58X (FIGS. 10, 11). These latches extend from a latch mounting rail 47X (FIG. 8) secured to the trowel. By lifting upwardly on the latches, they can be untensioned. The prong portions 65X (FIG. 9) may be withdrawn from shroud orifices 61X. At this time, the shroud is free to be lifted upwardly away from trowel. A handle 67X on each end facilitates manipulation.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A motorized riding trowel comprising:

a frame;

means on said frame for powering said riding trowel;

rotor means driven by said powering means for treating a concrete surface;

protective shroud means releasably coupled to said frame for selectively covering said powering means, said shroud means comprising:

an upper, planar top surface;

integral right and left ends that angularly depend outwardly and downwardly from said upper planar surface;

a plurality of spaced apart ventilation louvers defined in said left and right ends;

hinge means for hinging said shroud means to said frame at one of said shroud means ends, said hinge means comprising an external pivot hinge established at the bottom of said one of said shroud means ends and an internal hinge controlling an air cylinder connected to said shroud means for dampening movement; and, means at an opposite shroud means end for at least temporarily latching said shroud means to said frame;

a seat disposed upon said shroud means for supporting an operator.

2. The trowel as defined in claim 1 wherein said shroud means comprises a front and a spaced apart back formed from rigid material establishing a positive airflow between the front and back to dissipate heat.

3. A motorized riding trowel comprising:

a frame;

means on said frame for powering said riding trowel;

rotor means driven by said powering means for treating a concrete surface;

protective shroud means connected to said frame at one end by hinge means and releasably latched to said frame at an opposite end for selectively covering said powering means; and, a seat disposed upon said shroud means for supporting an operator.

4. The trowel as defined in claim 3 wherein said shroud means comprises a trapezoidal front and a spaced apart trapezoidal back formed from rigid perforated mesh material establishing a positive airflow between the front and back to dissipate heat.

5. The trowel as defined in claim 4 wherein said shroud means further comprises:

an upper, planar top surface supporting said seat;

integral right and left ends that angularly depend outwardly and downwardly from said upper planar surface; and, a plurality of spaced apart ventilation louvers defined in each end.

6. The trowel as defined in claim 5 wherein said hinge means for hinging said shroud means to said frame at one of said shroud means ends comprises an external pivot hinge established at the bottom of said one of said shroud means ends, and an internal hinge controlling cylinder means for dampening shroud means movement.

7. A motorized riding trowel comprising:

a frame;

motor means on said frame for powering said riding trowel;

rotor means driven by said powering means for treating a concrete surface;

protective shroud means releasably latched to said frame for selectively covering said motor means, said shroud means establishing a positive airflow to dissipate heat, said shroud means comprising:

a trapezoidal front and a spaced-apart, trapezoidal back formed from rigid, perforated, mesh material establishing a positive airflow between the front and back to dissipate heat;

an upper, planar top surface;

integral right and left ends that angularly depend outwardly and downwardly from said upper planar surface; and, a plurality of spaced apart ventilation louvers defined in each end;

a seat disposed upon said shroud means for supporting an operator;

hinge means for hinging said shroud means to said frame at one of said shroud means ends;

latch means at an opposite shroud means end for at least temporarily latching said shroud means to said frame; and, an air cylinder connected to said shroud means for dampening shroud means movement.

* * * * *